US011021657B2

(12) United States Patent
Iddir et al.

(10) Patent No.: US 11,021,657 B2
(45) Date of Patent: Jun. 1, 2021

(54) PROCESS AND APPARATUS FOR A CONVECTION CHARGE HEATER HAVING A RECYCLE GAS DISTRIBUTOR

(71) Applicant: UOP LLC, Des Plaines, IL (US)

(72) Inventors: Hadjira Iddir, Hoffman Estates, IL (US); William M. Hartman, Des Plaines, IL (US); Robert J. Sanger, Mount Prospect, IL (US); Bryan J. Egolf, Crystal Lake, IL (US); Nitin Prabhakar Chitgopekar, Hoffman Estates, IL (US); William Yanez, Crystal Lake, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 16/396,254

(22) Filed: Apr. 26, 2019

(65) Prior Publication Data

US 2019/0330538 A1 Oct. 31, 2019

Related U.S. Application Data

(60) Provisional application No. 62/663,093, filed on Apr. 26, 2018.

(51) Int. Cl.

| | |
|---|---|
| ***C10G 9/00*** | (2006.01) |
| ***C10G 9/20*** | (2006.01) |
| ***F27D 9/00*** | (2006.01) |
| ***F27D 7/02*** | (2006.01) |

(52) U.S. Cl.

CPC ..... *C10G 9/206* (2013.01); *F27D 7/02* (2013.01); *F27D 9/00* (2013.01); *F27D 2007/023* (2013.01); *F27D 2009/0075* (2013.01)

(58) Field of Classification Search

CPC ... C10G 9/206; F27D 9/00; F27D 7/02; F27D 2007/023; F27D 2009/0075

See application file for complete search history.

(56) References Cited

U.S. PATENT DOCUMENTS

| | | | |
|---|---|---|---|
| 3,760,168 | A | 9/1973 | Boyd |
| 4,522,157 | A | 6/1985 | O'Sullivan et al. |
| 5,879,537 | A | 3/1999 | Peters |
| 7,740,751 | B2 | 6/2010 | Peters |
| 9,206,358 | B2 | 12/2015 | Hartman et al. |

(Continued)

FOREIGN PATENT DOCUMENTS

| | | | |
|---|---|---|---|
| KR | 20090091155 | A | 8/2009 |
| RU | 2208623 | C2 | 7/2003 |

(Continued)

OTHER PUBLICATIONS

International Search Report from corresponding PCT application No. PCT/US2019/029453, dated Jul. 1, 2019.

(Continued)

*Primary Examiner* — Prem C Singh
*Assistant Examiner* — Brandi M Doyle

(57) ABSTRACT

Processes and apparatuses for relocating a reforming process heater service into the convection section rely on combining a flue gas recycle quench stream with the radiant section off gases entering the convection section. The uniformity of mixing influences the effectiveness of that quench stream. The more effective the quench stream is, the lower the equipment size required to manage the recycle design.

19 Claims, 2 Drawing Sheets

(56) References Cited

U.S. PATENT DOCUMENTS

| | | | | |
|---|---|---|---|---|
| 2002/0146657 | A1* | 10/2002 | Anderson | B23K 1/008 432/11 |
| 2010/0187823 | A1 | 7/2010 | Towler et al. | |
| 2013/0192249 | A1 | 8/2013 | Widener | |

FOREIGN PATENT DOCUMENTS

| | | | |
|---|---|---|---|
| SU | 710522 | A3 | 1/1980 |
| SU | 1693025 | A1 | 11/1991 |
| WO | 2010028270 | A1 | 3/2010 |
| WO | 2010117614 | A2 | 10/2010 |

OTHER PUBLICATIONS

Search Report from corresponding Russian application No. 2020137071 dated Feb. 15, 2021.
Office Action from corresponding Indian application No. 202017047334 dated Feb. 18, 2021.

* cited by examiner

PROCESS AND APPARATUS FOR A CONVECTION CHARGE HEATER HAVING A RECYCLE GAS DISTRIBUTOR

RELATED APPLICATIONS

This application claims the benefit of U.S. Provisional Patent Application Ser. No. 62/663,093, filed on Apr. 26, 2018, the entirety of which is incorporated herein by reference.

FIELD

The present invention is direct generally towards processes and apparatuses for controlling a temperature profile in a convection section of a heater. The uniformity of mixing influences the effectiveness of that quench stream. The more effective the quench stream is, the lower the equipment size required to manage the recycle design.

BACKGROUND

Hydrocarbon conversion processes often employ a series of reaction zones through which hydrocarbons pass. Each reaction zone may have its own unique process requirements, including a required temperature. Accordingly, each reaction zone requires a sufficient amount of heating upstream of the reaction zone to achieve the required temperature for performing, in the reaction zone, the desired hydrocarbon conversion.

For example, one well-known hydrocarbon conversion process is catalytic reforming. Catalytic reforming is a well-established hydrocarbon conversion process employed in the petroleum refining industry for improving the octane quality of hydrocarbon feed streams. The primary product of catalytic reforming is a gasoline blending component or a source of aromatics for petrochemicals. Reforming may be defined as the total effect produced by dehydrogenation of cyclohexanes and dehydroisomerization of alkylcyclopentanes and high carbon content $C_6$ to $C_7$ naphthenes to yield aromatics, dehydrogenation of paraffins to yield olefins, dehydrocyclization of paraffins and olefins to yield aromatics, isomerization of n-paraffins, isomerization of alkylcycloparaffins to yield cyclohexanes, isomerization of substituted aromatics, and hydrocracking of paraffins. A reforming feed stream can be a product stream from a hydrocracker, a fluid catalytic cracker (FCC), or a coker, or a straight run naphtha feed, and can contain many other components such as a condensate or a thermal cracked naphtha.

Heaters or furnaces are often used in hydrocarbon conversion processes, such as reforming, to heat the process fluid before it is reacted in the reforming reaction zone, or reactor. Generally, fired heaters or furnaces include a radiant fired heating zone to heat the fluid, with a convective section being used for another service, such as producing steam. Each section includes tubes which contain the process fluid flowing through the heater. The U-tube fired heater assembly is an expensive mainstay of catalytic reforming. This U-tube design combines several key advantages, including: (a) a low coil pressure drop, (b) flexibility in duty specifications between cells, (c) ability to integrate multiple cells with a common heat recovery system, and (d) turndown control that protects downstream plate-type exchanger from sudden temperature changes.

Typical reforming process designs have developed duty specifications for the multiple fired heater cells in order to provide the same duct temperature to each reaction stage.

However, in view of the rising costs of fuel, conventional designs suffer disadvantages. Specifically, the production of steam by convective sections is non-optimal as steam is provided in other areas of hydrocarbon processing plants. Rather, heat from the fuel combusted in the radiant fired heating zone can be better concentrated on an increase in enthalpy in hydrocarbon processing.

Accordingly, process for processing hydrocarbons utilizing convective sections to heat hydrocarbon streams have been developed. For example, U.S. Pat. No. 9,206,358 describes a process for heating a feed stream in a convective bank. The feed stream is reacted in a first reaction zone to form a first effluent. The first effluent is heated is a first radiant cell that combusts fuel gas to heat the first effluent and forms a first exhaust gas. The process includes contacting first exhaust gas with the convective bank to heat the feed stream. However, this process does not permit effective temperature control for the charge heater discharge temperature, resulting in reduction in overall yield of the first reactor process.

Therefore, there is a need for processes and apparatuses having a convection section that efficiently and effectively provides for temperature control and a more uniform and consistent temperature profile within the heater.

SUMMARY OF THE INVENTION

As noted above, apparatuses and processes have been invented which provide temperature control and a more uniform and consistent temperature profile within a heater, and more specifically within a convection section of the heater. The present invention generally combines a recycle quench stream with the radiant section off gases entering the convection section. The quench gas, or cooling gas, may be recycled flue gas having a lower temperature, but higher density and velocity. This provides the temperature control and a more uniform temperature profile in the heater. Thus, the effectiveness of the quench steam is increased, allowing for reduced equipment size required to manage the quench steam.

Accordingly, the present invention may be generally described as providing a process for controlling heating of a process fluid by: passing a first portion of a first gas stream into a first duct from a first plurality of ducts; passing a second portion of the first gas stream into a second duct from the first plurality of ducts, the second duct adjacent to the first duct; mixing the first and second portions of the first gas stream in a convection section to heat a process fluid in a conduit in the convection section; and, passing a first cooling gas stream into at least one opening between the first duct and the second duct to allow for even mixing of the gases. The first gas stream may be a radiant flue gas. The first gas stream may have a temperature between about 650-982° C. (1200-1800° F.) or about 788-871° C. (1450-1600° F.). The first cooling gas stream may be at a temperature of about 10-260° C. (50-500° F.) or about 120-200° C. (250-400° F.). The first and second portions of the first gas stream may be passed into the first and second ducts, respectively, in a relatively vertical direction. The first cooling gas stream may be passed into the at least one opening at a relatively horizontal direction. The at least one opening is located between the first duct and the second duct. The process may also include: passing a first portion of a second gas stream into a first duct from a second plurality of ducts; passing a second portion of the second gas stream into a second duct from the second plurality of ducts, the second duct adjacent to the first duct; mixing the first and second portions of the second gas stream in a second convection section to heat a process fluid in a conduit in the second convection section; and, passing a second cooling gas stream into at least one opening between the first duct and the second duct of the second plurality of ducts to allow for even mixing of the gases. The second gas stream may be a radiant flue gas. A conduit may extend between the two convection sections, and the cooling gas stream may be passed through the conduit, and the second cooling gas stream may be a portion of the cooling gas stream.

The present invention may also be described as providing a process for controlling heating of a process fluid by: passing a first portion of a first radiant flue gas into a first duct from a first plurality of ducts; passing a second portion of the first radiant flue gas into a second duct from the first plurality of ducts, the second duct from the first plurality of ducts adjacent to the first duct from the first plurality of ducts; mixing the first and second portions of the first radiant flue gas in a first convection section to heat a process fluid in a conduit in the first convection section; passing a first portion of a second radiant flue gas into a first duct from a second plurality of ducts; passing a second portion of the second radiant flue gas into a second duct from the second plurality of ducts, the second duct from the second plurality of ducts adjacent to the first duct from the second plurality of ducts; mixing the first and second portions of the second radiant flue gas in a second convection section to heat a process fluid in a conduit in the second convection section; passing a first stream of a cooling gas into at least one opening between the first duct and the second duct of the first plurality of ducts; and, passing a second stream of the cooling gas into at least one opening between the first duct and the second duct of the second plurality of ducts. The first and the second radiant flue gases may each be at a temperature between about 650-982° C. (1200-1800° F.) or about 788-871° C. (1450-1600° F.). The cooling gas may be at a temperature between about 10-260° C. (50-500° F.) or about 120-200° C. (250-400° F.). The first and second portions of the first radiant flue gas may be passed into the first duct from the first plurality of ducts and the second duct from the first plurality of ducts, respectively, in a relatively vertical direction. The first and second portions of the second radiant flue gas may be passed into the first duct from the second plurality of ducts and the second duct from the second plurality of ducts, respectively, in a relatively vertical direction. The first stream of the cooling gas may be passed into the at least one opening between the first duct from the first plurality of ducts and the second duct from the first plurality of ducts at a relatively horizontal direction. The second stream of the cooling gas may be passed into the at least one opening between the first duct from the second plurality of ducts and the second duct from the second plurality of ducts at a relatively horizontal direction.

The present invention may further be described as providing an apparatus for processing a hydrocarbon stream which includes: a first duct configured to receive a first portion of a first radiant flue gas; a second duct configured to receive a second portion of the first radiant flue gas; a convection section located above the first and the second ducts, wherein the first and second ducts are configured to release the first and second portions of the first radiant flue gas into the convection section so that the first and second first radiant flue gas mix; and, a distribution conduit configured to inject a cooling gas into a portion of the convection section between the first duct and the second duct.

In one or more aspects, the present invention provides a process for processing a hydrocarbon stream, the process comprising passing a first gas stream into a first plurality of ducts; passing a second gas stream into a second plurality of ducts; mixing the first gas stream and the second gas stream in a convection section; passing a first flue gas stream into a first plurality of openings between the first plurality of ducts that allows for even mixing of the gases; and passing a second flue gas stream into a second plurality of openings between the second plurality of ducts that allows for even mixing of the gases. An embodiment of the invention is one, any or all of prior embodiments in this paragraph up through the first embodiment in this paragraph, wherein the first gas stream comprises a fresh gas, a recycled portion of the first exhaust gas, or a combination thereof. An embodiment of the invention is one, any or all of prior embodiments in this paragraph up through the first embodiment in this paragraph, wherein the first gas stream and the second gas stream are a temperature of about 700° C. to about 900° C. (about 1290° F. to about 1650° F.), wherein the weighted average is approximated 800° C. (about 1470° F.). An embodiment of the invention is one, any or all of prior embodiments in this paragraph up through the first embodiment in this paragraph, wherein the first flue gas stream and the second flue gas stream are a temperature of about 600° C. to about 800° C. (about 1110° F. to about 1470° F.), wherein the weighted average is approximately 700° C. (about 1290° F.). An embodiment of the invention is one, any or all of prior embodiments in this paragraph up through the first embodiment in this paragraph, wherein there are three openings in each bay, wherein the bay is the space between tube supports. An embodiment of the invention is one, any or all of prior embodiments in this paragraph up through the first embodiment in this paragraph, wherein there may be at one to four openings in between each duct. An embodiment of the invention is one, any or all of prior embodiments in this paragraph up through the first embodiment in this paragraph, wherein the first plurality of ducts comprises seven ducts. An embodiment of the invention is one, any or all of prior embodiments in this paragraph up through the first embodiment in this paragraph, wherein the second plurality of ducts comprises seven ducts. An embodiment of the invention is one, any or all of prior embodiments in this paragraph up through the first embodiment in this paragraph, wherein openings may be located between each duct. An embodiment of the invention is one, any or all of prior embodiments in this paragraph up through the first embodiment in this paragraph, further comprising at least one of sensing at least one parameter of the process and generating a signal or data from the sensing; generating and transmitting a signal; or generating and transmitting data.

In some aspects the present invention provides an apparatus for processing a hydrocarbon stream comprising a line configured to pass a first gas stream into a first plurality of ducts; a line configured to pass a second gas stream into a second plurality of ducts; a mixer that mixes the first gas stream and the second gas stream in a convection section; a line configured to pass a first flue gas stream into a first plurality of openings between the first plurality of ducts that allows for even mixing of the gases; and a line configured to pass a second flue gas stream into a second plurality of openings between the second plurality of ducts that allows for event mixing of the gases. An embodiment of the invention is one, any or all of prior embodiments in this paragraph up through the second embodiment in this paragraph, wherein the first gas stream comprises a fresh gas, a recycled portion of the first exhaust gas, or a combination thereof. An embodiment of the invention is one, any or all of prior embodiments in this paragraph up through the second embodiment in this paragraph, wherein the first gas stream and the second gas stream are a temperature of about 700° C. to about 900° C. (about 1290° F. to about 1650° F.), wherein the weighted average is approximated 800° C. (about 1470° F.). An embodiment of the invention is one, any or all of prior embodiments in this paragraph up through the second embodiment in this paragraph, wherein the first flue gas stream and the second flue gas stream are a temperature of about 600° C. to about 800° C. (about 1110° F. to about 1470° F.), wherein the weighted average is approximately 700° C. (about 1290° F.). An embodiment of the invention is one, any or all of prior embodiments in this paragraph up through the second embodiment in this paragraph, wherein there are three openings in each bay, wherein the bay is the space between tube supports. An embodiment of the invention is one, any or all of prior embodiments in this paragraph up through the second embodiment in this paragraph, wherein there may be at one to four openings in between each duct. An embodiment of the invention is one, any or all of prior embodiments in this paragraph up through the second embodiment in this paragraph, wherein the first plurality of ducts comprises 7 ducts. An embodiment of the invention is one, any or all of prior embodiments in this paragraph up through the second embodiment in this paragraph, wherein the second plurality of ducts comprises 7 ducts. An embodiment of the invention is one, any or all of prior embodiments in this paragraph up through the second embodiment in this paragraph, wherein openings may be located between each duct. An embodiment of the invention is one, any or all of prior embodiments in this paragraph up through the second embodiment in this paragraph, further comprising at least one of a sensor positioned at a location to sense at least one parameter; a transmitter; and a computing device.

Definitions

As used herein, the term "stream", "feed", "product", "part" or "portion" can include various hydrocarbon molecules, such as straight-chain, branched, or cyclic alkanes, alkenes, alkadienes, and alkynes, and optionally other substances, such as gases, e.g., hydrogen, or impurities, such as heavy metals, and sulfur and nitrogen compounds. Each of the above may also include aromatic and non-aromatic hydrocarbons.

Hydrocarbon molecules may be abbreviated C1, C2, C3, Cn where "n" represents the number of carbon atoms in the one or more hydrocarbon molecules or the abbreviation may be used as an adjective for, e.g., non-aromatics or compounds. Similarly, aromatic compounds may be abbreviated A6, A7, A8, An where "n" represents the number of carbon atoms in the one or more aromatic molecules. Furthermore, a superscript "+" or "−" may be used with an abbreviated one or more hydrocarbons notation, e.g., C3+ or C3−, which is inclusive of the abbreviated one or more hydrocarbons. As an example, the abbreviation "C3+" means one or more hydrocarbon molecules of three or more carbon atoms.

As used herein, the term "zone" can refer to an area including one or more equipment items and/or one or more sub-zones. Equipment items can include, but are not limited to, one or more reactors or reactor vessels, separation vessels, distillation towers, heaters, exchangers, pipes, pumps, compressors, and controllers. Additionally, an equipment item, such as a reactor, dryer, or vessel, can further include one or more zones or sub-zones.

DETAILED DESCRIPTION OF THE INVENTION

The drawings illustrate an embodiment of a process and apparatus for hydrocarbon processing as applied to a catalytic reforming process. The drawings are presented solely for purposes of illustration and are not intended to limit the scope of the claims as set forth below. Additionally, the drawings show only the equipment and lines necessary for an understanding of various embodiments herein and do not show equipment such as pumps, compressors, heat exchangers, and valves which are not necessary for an understanding of the process and apparatus claimed herein and which are well known to persons of ordinary skill in the art of hydrocarbon processing.

Figure 1A:
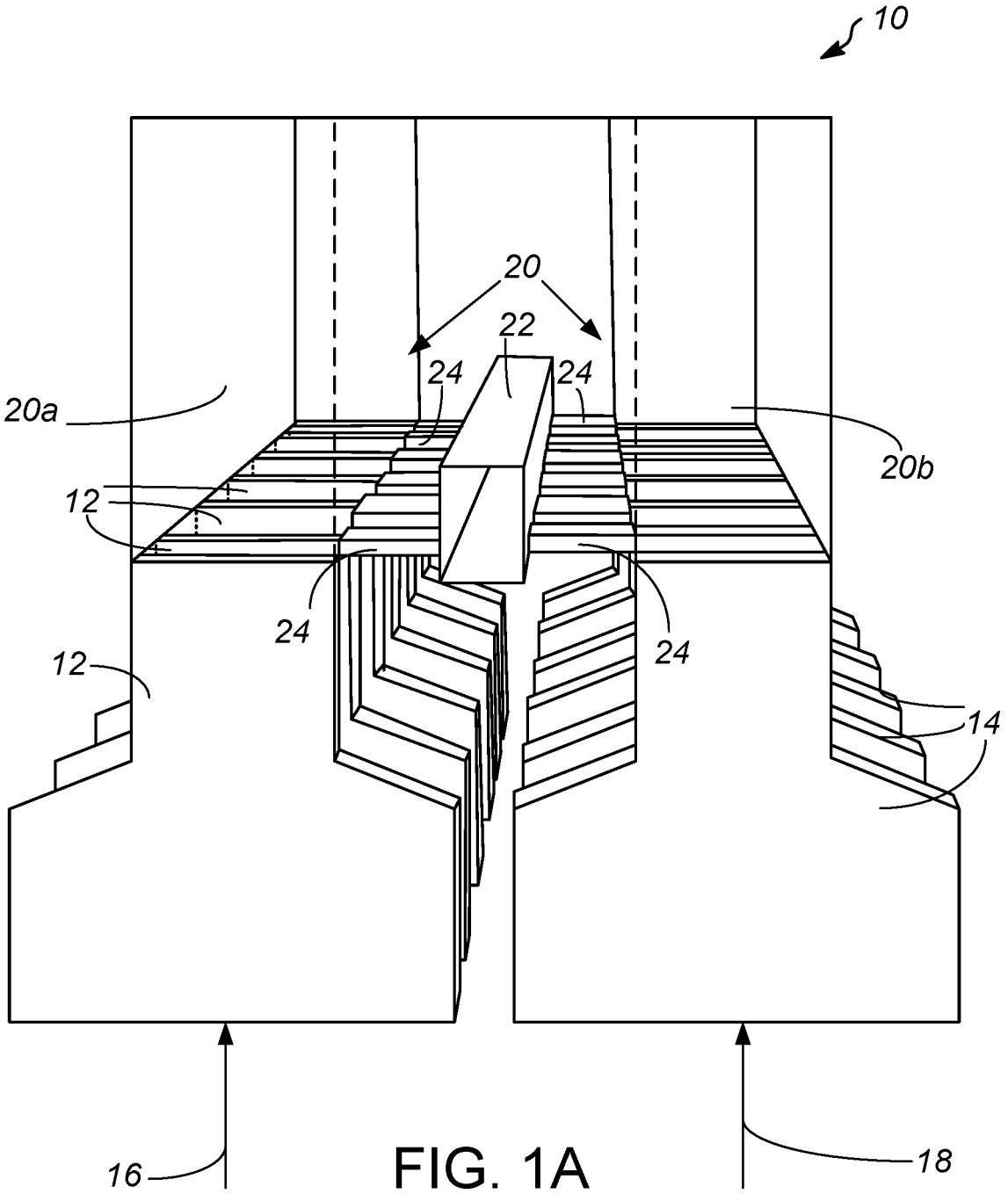
FIG. 1A shows a schematic front perspective view of an apparatus for heating a feed stream according to the present invention.

Referring to FIG. 1A, an apparatus 10 according to various aspects of the present invention is shown. The apparatus 10 includes a first plurality of ducts 12 and second plurality of ducts 14. In the example illustrated in FIG. 1A, there are seven ducts 12 in the first plurality and seven ducts 14 in the second plurality. However, the numbers of ducts 12, 14 in each plurality may be different depending on the size of the configuration of the apparatus 10. For example, the first plurality of ducts 12 may include between three and ten ducts 12. Similarly, the second set of ducts 14 may include between three and ten ducts 12.

Each of the ducts 12, 14 from each plurality receive a gas stream 16, 18 from a radiant section of one or more heaters (not shown) which may be for example disposed beneath the ducts 12, 14. The heaters are not shown or described in detail here but are explained more in detail in U.S. Pat. No. 9,206,358. For clarity purposes in FIG. 1A only the frontmost ducts 12, 14 are shown receiving the first and second gas streams 16, 18, respectively. In the example illustrated in FIG. 1A, the first gas stream 16 and the second gas stream 18 comprise off gases from the radiant section of the heater, i.e., radiant flue gases. Within each of the ducts 12, 14 the respective gas streams 16, 18 rise and enter a convection section 20 of the apparatus. In the depicted embodiment the convection section 20 has two portions 20*a*, 20*b*, one section 20*a*, 20*b* above each of the pluralities of ducts 12, 14.

In the first convection section 20*a*, the first gas stream 16 from each of the first ducts 12 may mix and be used to heat process tubes (not shown) extending through the convection section 20*a* above the first ducts 12. Similarly, the second gas stream 18 from each of the second ducts 14 may mix and be used to heat process tubes (not shown) extending through the convection section 20*b* above the second ducts 14. The tubes in the convection sections 20*a*, 20*b* are depicted in more detail in U.S. Pat. No. 9,206,358. As discussed above, the present disclosure is directed at providing a more consistent and predictable temperature profile along the length of the tubes (i.e., between the individual ducts 12, 14 within each of the pluralities).

Accordingly, as shown in FIG. 1A a cooling gas conduit 22 extends between the two ducts 12, 14 which distributes a cooling gas to each of the convection sections 20*a*, 20*b*. Compared to the gas in the first and second gas streams 16, 18, the cooling gas has a lower temperature, higher density and higher velocity. Extending between the convection sections 20*a*, 20*b* and the cooling gas conduit 22 are distribution conduits 24 which transfer the cooling gas from the cooling gas conduit 22 to the convection sections 20*a*, 20*b*.

Figure 1B:
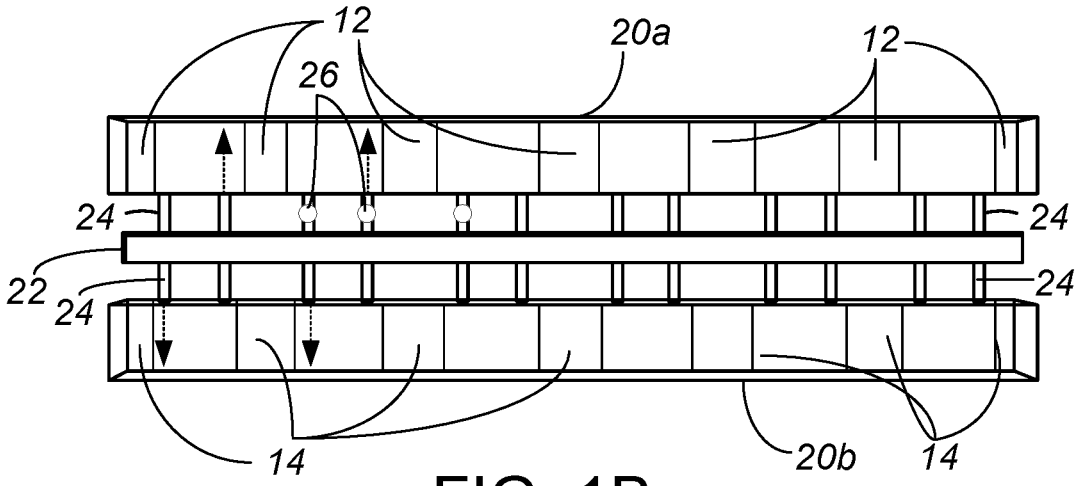
FIG. 1B shows top view of a portion of the apparatus shown in FIG. 1A; and, FIG. 1C shows a front and side perspective view of a portion of the apparatus shown in FIG. 1A.

Turning now to FIG. 1B, the distribution conduits 24 run parallel to the ducts 12, 14. In the embodiment illustrated in FIG. 1B, there are twelve distribution conduits 24 for each plurality of ducts 12, 14. However, it is contemplated that any number of distribution conduits 24 may be used to distribute the cooling gas as necessary which may depend on the space between adjacent ducts.

It is contemplated that there may be flow control devices 26 such as valves or dampers the distribution conduits 24. The flow control devices 26 enable a balance of flue gas flowing vertically upwards and cooling gas flowing horizontally (see dashed arrows in FIG. 1B). In a preferred embodiment, the distribution conduits 24 are sized to receive a recycle flue gas having a velocity of about 5 feet/second to about 50 feet/second.

Figure 1C:
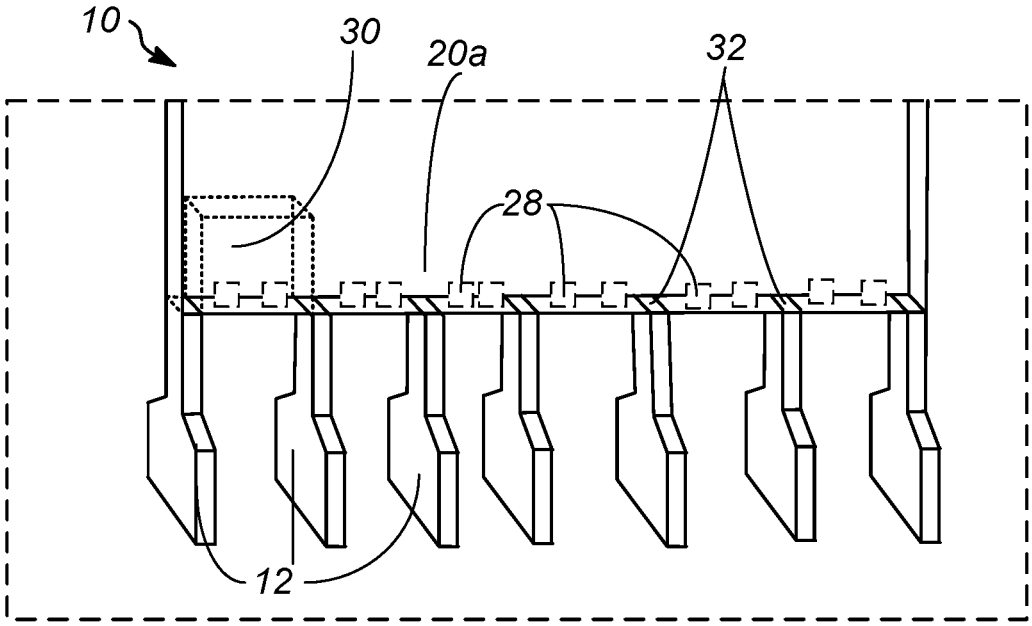

Turning now to FIG. 1C, only the first plurality of ducts 12 and the first convection section 20*a* are shown to depict that the apparatus 10 comprises openings 28 for injecting the cooling gas from the distribution conduits 24 (FIGS. 1A, 1B). It has been found that the location of the openings 28 is particularly advantageous when the openings 28 are located between adjacent ducts 12 at the floor, or bottom, of the convection section 20*a*. While, it also contemplated that the openings 28 may be located, for example, in the ducts 12 themselves at the top proximate the convection section 20*a*. As noted above, the depicted location has proven to be particularly advantageous to provide a relatively uniform and consistent profile across a horizontal level of the apparatus 10.

As shown in FIG. 1C there are two openings 28 between each set of adjacent ducts 12. This is merely exemplary and the number of openings 28 may be any number as necessary which may depend on the space between adjacent ducts, and should preferably be the same as the number of distribution conduits 24. It has been found that two openings 28 is particularly advantageous in some configurations of the apparatus 10.

According to the depicted configuration, the cooling gas is introduced into portions 30 of the convection section 20*a* in between the ducts outlets 32 for the convection section 20*a*. This arrangement avoids significant pass-to-pass maldistribution of the radiant gas velocity. The primary reason identified for this is the density differences between the gases being mixed, and the low velocities of mixing. The number and velocity of gases passed at these entrance ducts was found important to generate proper mixing. Further, the high velocities within the distributor entrance acts to premixing the gases together at the entrance to the convection section.

More specifically, it is believed that mixing a low-velocity, low-density gas flowing vertically (gas streams 16, 18) with a high-velocity, high-density gas flowing horizontally (cooling gas) provided the benefits discussed above. However, given a narrow horizontal mixing length typically provided in such an apparatus, the present apparatus surprisingly results in sufficient mixing.

Preferred features of the first and second gas streams 16, 18 and the cooling gas are shown in the below TABLE 1.

TABLE 1

| | Cooling Gas | First and Second Gas Streams (Radiant Flue Gas) |
|---|---|---|
| Temp Range ° C. (° F.) | 10-260° C. (50-500° F.) | 650-982° C. (1200-1800° F.) |
| | 120-200° C. (250-400° F.) (preferred) | 788-871° C. (1450-1600° F.) (preferred) |
| Density Range kg/m$^3$ (lb/ft$^3$) | 0.32-2.4 kg/m$^3$ (0.02-0.15 lb/ft$^3$) | 0.16-0.80 kg/m$^3$ (0.01-0.05 lb/ft$^3$) |
| | 0.64-1.3 kg/m$^3$ (0.04-0.08 lb/ft$^3$) (preferred) | 0.16-0.48 kg/m$^3$ (0.01-0.03 lb/ft$^3$) (preferred) |
| Velocity Range m/s (ft/s) | 0.3-15 m/s (1-50 ft/s) | 0.3-15 m/s (1-50 ft/s) |
| | 3.0-9.1 m/s (10-30 ft/s) (preferred) | 1.5-6.1 m/s (5-20 ft/s) (preferred) |
| Angle from Vertical | +45° to +135° | −45° to +45° |
| | 70° to +110° (preferred) | −12° to +12° (preferred) |

One of ordinary skill in the art will recognize that at least some of these features in TABLE 1 will be dependent on the physical layout of the convection section.

For example, it is believed that these preferred ranges are particularly applicable to a convention section with a width (distance of between about 1 to 10.5 meters (3 to 35 feet)) measured perpendicularly to the tubes in the convection section (e.g., distance measured left to right of 20*a* in FIG. 1A). Accordingly, in the various embodiments, a ratio of inlet velocity of the cooling gas to width of convention section may be between 0.1 to 17 sec$^{-1}$, preferably between 0.8 to 10 sec$^{-1}$. Additionally, a ratio of the first and second gas streams 16, 18 to convention section width may be between 0.05 to 0.9 sec$^{-1}$, preferably between 0.1 to 0.5 sec$^{-1}$.

In the foregoing embodiments, two pluralities of ducts 12, 14 were depicted; however, it is contemplated that only one plurality of ducts are present in the apparatus 10.

As described herein, an apparatus and process for heating a hydrocarbon stream for processing have been provided. In exemplary embodiments, an apparatus and process have been described for catalytic reforming processes, though any suitable apparatus and process for processing hydrocarbons may utilize the heating process discloses herein. Although the embodiments discussed above can be designed for a new hydrocarbon processing apparatus, it should be understood that the disclosed features can implemented during the revamp of an existing apparatus.

Any of the above lines, conduits, units, devices, vessels, surrounding environments, zones or similar may be equipped with one or more monitoring components including sensors, measurement devices, data capture devices or data transmission devices. Signals, process or status measurements, and data from monitoring components may be used to monitor conditions in, around, and on process equipment. Signals, measurements, and/or data generated or recorded by monitoring components may be collected, processed, and/or transmitted through one or more networks or connections that may be private or public, general or specific, direct or indirect, wired or wireless, encrypted or not encrypted, and/or combination(s) thereof; the specification is not intended to be limiting in this respect. Signals, measurements, and/or data generated or recorded by monitoring components may be transmitted to one or more computing devices or systems.

Computing devices or systems may include at least one processor and memory storing computer-readable instructions that, when executed by the at least one processor, cause the one or more computing devices to perform a process that may include one or more steps. For example, the one or more computing devices may be configured to receive, from one or more monitoring component, data related to at least one piece of equipment associated with the process. The one or more computing devices or systems may be configured to analyze the data. Based on analyzing the data, the one or more computing devices or systems may be configured to determine one or more recommended adjustments to one or more parameters of one or more processes described herein. The one or more computing devices or systems may be configured to transmit encrypted or unencrypted data that includes the one or more recommended adjustments to the one or more parameters of the one or more processes described herein.

Specifically, one or more temperature sensors associate with tubes, the convection section or any other section may be monitored and the flow of the cooling gas may be adjusted to increase or decrease the amount of cooling gas injected into the convection section to provide a desired temperature therein.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the claimed subject matter in any way. Rather, the foregoing detailed description will provide those skilled in the art with a convenient road map for implementing an exemplary embodiment or embodiments. It being understood that various changes may be made in the function and arrangement of elements described in an exemplary embodiment without departing from the scope set forth in the appended claims.

Specific Embodiments

While the following is described in conjunction with specific embodiments, it will be understood that this description is intended to illustrate and not limit the scope of the preceding description and the appended claims.

A first embodiment of the invention is a process for processing a hydrocarbon stream, the process comprising passing a first gas stream into a first plurality of ducts; passing a second gas stream into a second plurality of ducts; mixing the first gas stream and the second gas stream in a convection section; passing a first flue gas stream into a first plurality of openings between the first plurality of ducts that allows for even mixing of the gases; and passing a second flue gas stream into a second plurality of openings between the second plurality of ducts that allows for event mixing of the gases. An embodiment of the invention is one, any or all of prior embodiments in this paragraph up through the first embodiment in this paragraph, wherein the first gas stream comprises a fresh gas, a recycled portion of the first exhaust gas, or a combination thereof. An embodiment of the invention is one, any or all of prior embodiments in this paragraph up through the first embodiment in this paragraph, wherein the first gas stream and the second gas stream are a temperature of about 700° C. to about 900° C. (about 1290° F. to about 1650° F.), wherein the weighted average is approximated 800° C. (about 1470° F.). An embodiment of the invention is one, any or all of prior embodiments in this paragraph up through the first embodiment in this paragraph, wherein the first flue gas stream and the second flue gas stream are a temperature of about 600° C. to about 800° C. (about 1110° F. to about 1470° F.), wherein the weighted average is approximately 700° C. (about 1290° F.). An embodiment of the invention is one, any or all of prior embodiments in this paragraph up through the first embodiment in this paragraph, wherein there are three openings in each bay, wherein the bay is the space between tube supports. An embodiment of the invention is one, any or all of prior embodiments in this paragraph up through the first embodiment in this paragraph, wherein there may be at one to four openings in between each duct. An embodiment of the invention is one, any or all of prior embodiments in this paragraph up through the first embodiment in this paragraph, wherein the first plurality of ducts comprises seven ducts. An embodiment of the invention is one, any or all of prior embodiments in this paragraph up through the first embodiment in this paragraph, wherein the second plurality of ducts comprises seven ducts. An embodiment of the invention is one, any or all of prior embodiments in this paragraph up through the first embodiment in this paragraph, wherein openings may be located between each duct. An embodiment of the invention is one, any or all of prior embodiments in this paragraph up through the first embodiment in this paragraph, further comprising at least one of sensing at least one parameter of the process and generating a signal or data from the sensing; generating and transmitting a signal; or generating and transmitting data.

A second embodiment of the invention is an apparatus for processing a hydrocarbon stream comprising a line configured to pass a first gas stream into a first plurality of ducts; a line configured to pass a second gas stream into a second plurality of ducts; a mixer that mixes the first gas stream and the second gas stream in a convection section; a line configured to pass a first flue gas stream into a first plurality of openings between the first plurality of ducts that allows for even mixing of the gases; and a line configured to pass a second flue gas stream into a second plurality of openings between the second plurality of ducts that allows for event mixing of the gases. An embodiment of the invention is one, any or all of prior embodiments in this paragraph up through the second embodiment in this paragraph, wherein the first gas stream comprises a fresh gas, a recycled portion of the first exhaust gas, or a combination thereof. An embodiment of the invention is one, any or all of prior embodiments in this paragraph up through the second embodiment in this paragraph, wherein the first gas stream and the second gas stream are a temperature of about 700° C. to about 900° C. (about 1290° F. to about 1650° F.), wherein the weighted average is approximated 800° C. (about 1470° F.). An embodiment of the invention is one, any or all of prior embodiments in this paragraph up through the second embodiment in this paragraph, wherein the first flue gas stream and the second flue gas stream are a temperature of about 600° C. to about 800° C. (about 1110° F. to about 1470° F.), wherein the weighted average is approximately 700° C. (about 1290° F.). An embodiment of the invention is one, any or all of prior embodiments in this paragraph up through the second embodiment in this paragraph, wherein there are three openings in each bay, wherein the bay is the space between tube supports. An embodiment of the invention is one, any or all of prior embodiments in this paragraph up through the second embodiment in this paragraph, wherein there may be at one to four openings in between each duct. An embodiment of the invention is one, any or all of prior embodiments in this paragraph up through the second embodiment in this paragraph, wherein the first plurality of ducts comprises seven ducts. An embodiment of the invention is one, any or all of prior embodiments in this paragraph up through the second embodiment in this paragraph, wherein the second plurality of ducts comprises seven ducts. An embodiment of the invention is one, any or all of prior embodiments in this paragraph up through the second embodiment in this paragraph, wherein openings may be located between each duct. An embodiment of the invention is one, any or all of prior embodiments in this paragraph up through the second embodiment in this paragraph, further comprising at least one of a sensor positioned at a location to sense at least one parameter; a transmitter; and a computing device.

A third embodiment of the invention is a process for controlling heating of a process fluid, the process comprising passing a first portion of a first gas stream into a first duct from a first plurality of ducts; passing a second portion of the first gas stream into a second duct from the first plurality of ducts, the second duct adjacent to the first duct; mixing the first and second portions of the first gas stream in a convection section to heat a process fluid in a conduit in the convection section; and, passing a first cooling gas stream into at least one opening between the first duct and the second duct to allow for even mixing of the gases. An embodiment of the invention is one, any or all of prior embodiments in this paragraph up through the third embodiment in this paragraph, wherein the first gas stream comprises a radiant flue gas. An embodiment of the invention is one, any or all of prior embodiments in this paragraph up through the third embodiment in this paragraph, wherein the first gas stream is at a temperature of about 650-982° C. (1200-1800° F.). An embodiment of the invention is one, any or all of prior embodiments in this paragraph up through the third embodiment in this paragraph, wherein the first gas stream is at a temperature of about 788-871° C. (1450-1600° F.). An embodiment of the invention is one, any or all of prior embodiments in this paragraph up through the third embodiment in this paragraph, wherein the first cooling gas stream is at a temperature of about 10-260° C. (50-500° F.). An embodiment of the invention is one, any or all of prior embodiments in this paragraph up through the third embodiment in this paragraph, wherein the first cooling gas stream is at a temperature of about 120-200° C. (250-400° F.). An embodiment of the invention is one, any or all of prior embodiments in this paragraph up through the third embodiment in this paragraph, wherein the first and second portions of the first gas stream are passed into the first and second ducts, respectively, in a relatively vertical direction. An embodiment of the invention is one, any or all of prior embodiments in this paragraph up through the third embodiment in this paragraph, wherein the first cooling gas stream is passed into the at least one opening at a relatively horizontal direction. An embodiment of the invention is one, any or all of prior embodiments in this paragraph up through the third embodiment in this paragraph, wherein the at least one opening is located between the first duct and the second duct. An embodiment of the invention is one, any or all of prior embodiments in this paragraph up through the third embodiment in this paragraph, further comprising passing a first portion of a second gas stream into a first duct from a second plurality of ducts; passing a second portion of the second gas stream into a second duct from the second plurality of ducts, the second duct adjacent to the first duct; mixing the first and second portions of the second gas stream in a second convection section to heat a process fluid in a conduit in the second convection section; and, passing a second cooling gas stream into at least one opening between the first duct and the second duct of the second plurality of ducts to allow for even mixing of the gases. An embodiment of the invention is one, any or all of prior embodiments in this paragraph up through the third embodiment in this paragraph, wherein the second gas stream comprises a radiant flue gas. An embodiment of the invention is one, any or all of prior embodiments in this paragraph up through the third embodiment in this paragraph, wherein a conduit extends between the two convection sections, and wherein the cooling gas stream is passed through the conduit, and wherein the second cooling gas stream comprises a portion of the cooling gas stream.

A fourth embodiment of the invention is a process for controlling heating of a process fluid, the process comprising passing a first portion of a first radiant flue gas into a first duct from a first plurality of ducts; passing a second portion of the first radiant flue gas into a second duct from the first plurality of ducts, the second duct from the first plurality of ducts adjacent to the first duct from the first plurality of ducts; mixing the first and second portions of the first radiant flue gas in a first convection section to heat a process fluid in a conduit in the first convection section; passing a first portion of a second radiant flue gas into a first duct from a second plurality of ducts; passing a second portion of the second radiant flue gas into a second duct from the second plurality of ducts, the second duct from the second plurality of ducts adjacent to the first duct from the second plurality of ducts; mixing the first and second portions of the second radiant flue gas in a second convection section to heat a process fluid in a conduit in the second convection section; passing a first stream of a cooling gas into at least one opening between the first duct and the second duct of the first plurality of ducts; and, passing a second stream of the cooling gas into at least one opening between the first duct and the second duct of the second plurality of ducts. An embodiment of the invention is one, any or all of prior embodiments in this paragraph up through the fourth embodiment in this paragraph, wherein the first and the second radiant flue gases are each at a temperature of about 650-982° C. (1200-1800° F.). An embodiment of the invention is one, any or all of prior embodiments in this paragraph up through the fourth embodiment in this paragraph, wherein the first and the second radiant flue gases are each at a temperature of about 788-871° C. (1450-1600° F.). An embodiment of the invention is one, any or all of prior embodiments in this paragraph up through the fourth embodiment in this paragraph, wherein the cooling gas is at a temperature of about 10-260° C. (50-500° F.). An embodiment of the invention is one, any or all of prior embodiments in this paragraph up through the fourth embodiment in this paragraph, wherein the cooling gas is at a temperature of about 120-200° C. (250-400° F.). An embodiment of the invention is one, any or all of prior embodiments in this paragraph up through the fourth embodiment in this paragraph, wherein the first and second portions of the first radiant flue gas are passed into the first duct from the first plurality of ducts and the second duct from the first plurality of ducts, respectively, in a relatively vertical direction; and, wherein the first and second portions of the second radiant flue gas are passed into the first duct from the second plurality of ducts and the second duct from the second plurality of ducts, respectively, in a relatively vertical direction. An embodiment of the invention is one, any or all of prior embodiments in this paragraph up through the fourth embodiment in this paragraph, wherein the first stream of the cooling gas is passed into the at least one opening between the first duct from the first plurality of ducts and the second duct from the first plurality of ducts at a relatively horizontal direction, and wherein the second stream of the cooling gas is passed into the at least one opening between the first duct from the second plurality of ducts and the second duct from the second plurality of ducts at a relatively horizontal direction.

A fifth embodiment of the invention is an apparatus for processing a hydrocarbon stream comprising a first duct configured to receive a first portion of a first radiant flue gas; a second duct configured to receive a second portion of the first radiant flue gas; a convection section located above the first and the second ducts, wherein the first and second ducts are configured to release the first and second portions of the first radiant flue gas into the convection section so that the first and second first radiant flue gas mix; and, a distribution conduit configured to inject a cooling gas into a portion of the convection section between the first duct and the second duct.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

The invention claimed is:

1. A process for controlling heating of a process fluid, the process comprising:

passing a first portion of a first gas stream into a first duct from a first plurality of ducts;

passing a second portion of the first gas stream into a second duct from the first plurality of ducts, the second duct adjacent to the first duct;

passing the first portion of the first gas stream through a first duct outlet and into a convection section;

passing the second portion of the first gas stream through a second duct outlet and into the convection section;

mixing the first and second portions of the first gas stream in the convection section to heat a process fluid in a conduit in the convection section; and, passing a first cooling gas stream into at least one opening between the first duct outlet and the second duct outlet to allow for even mixing of the gases, wherein the at least one opening is located at a bottom of the convention section.

2. The process of claim 1, wherein the first gas stream comprises a radiant flue gas.

3. The process of claim 1, wherein the first gas stream is at a temperature of about 650-982° C. (1200-1800° F.).

4. The process of claim 1, wherein the first gas stream is at a temperature of about 788-871° C. (1450-1600° F.).

5. The process of claim 1, wherein the first cooling gas stream is at a temperature of about 10-260° C. (50-500° F.).

6. The process of claim 1, wherein the first cooling gas stream is at a temperature of about 120-200° C. (250-400° F.).

7. The process of claim 1, wherein the first and second portions of the first gas stream are passed into the first duct and the second duct, respectively, in a relatively vertical direction.

8. The process of claim 7, wherein the first cooling gas stream is passed into the at least one opening at a relatively horizontal direction.

9. The process of claim 1, wherein the at least one opening is located between the first duct and the second duct.

10. The process of claim 1, further comprising:

passing a first portion of a second gas stream into a first duct from a second plurality of ducts;

passing a second portion of the second gas stream into a second duct from the second plurality of ducts, the second duct adjacent to the first duct;

passing the second portion of the second gas stream through a third duct outlet and into a second convection section;

passing the second portion of the second gas stream through a fourth duct outlet and into the second convection section;

mixing the first and second portions of the second gas stream in the second convection section to heat a process fluid in a conduit in the second convection section; and, passing a second cooling gas stream into at least one opening between the third duct outlet and the fourth duct outlet to allow for even mixing of the gases, wherein the at least one opening in the second convention section is located at a bottom of the second convention section.

11. The process of claim 10, wherein the second gas stream comprises a radiant flue gas.

12. The process of claim 10, wherein a conduit extends between the first and the second convection sections, and wherein the cooling gas stream is passed through the conduit, and wherein the second cooling gas stream comprises a portion of the cooling gas stream.

13. A process for controlling heating of a process fluid, the process comprising:

passing a first portion of a first radiant flue gas into a first duct from a first plurality of ducts;

passing a second portion of the first radiant flue gas into a second duct from the first plurality of ducts, the second duct from the first plurality of ducts adjacent to the first duct from the first plurality of ducts;

passing the first portion of the first radiant flue gas through a first duct outlet and into a first convection section;

passing the second portion of the first radiant flue gas through a second duct outlet and into the first convection section;

mixing the first and second portions of the first radiant flue gas in the first convection section to heat a process fluid in a conduit in the first convection section;

passing a first portion of a second radiant flue gas into a first duct from a second plurality of ducts;

passing a second portion of the second radiant flue gas into a second duct from the second plurality of ducts, the second duct from the second plurality of ducts adjacent to the first duct from the second plurality of ducts;

passing the first portion of second first radiant flue gas through a third duct outlet and into a second convection section;

passing the second portion of the second radiant flue gas through a fourth duct outlet and into the second convection section;

mixing the first and second portions of the second radiant flue gas in the second convection section to heat a process fluid in a conduit in the second convection section;

passing a first stream of a cooling gas into at least one opening between the first duct outlet and the second duct outlet; and, passing a second stream of the cooling gas into at least one opening between the third duct outlet and the fourth duct outlet, wherein the at least one opening of the first cooling gas stream, and the at least one opening of the second cooling gas stream are located at the bottom of the first and second convention sections, respectively wherein the at least one opening of the first cooling gas is between the first outlet and the second outlet, and wherein the at least one opening of the second cooling gas is between the third duct outlet and the fourth duct outlet.

14. The process of claim 13, wherein the first and the second radiant flue gases are each at a temperature of about 650-982° C. (1200-1800° F.).

15. The process of claim 13, wherein the first and the second radiant flue gases are each at a temperature of about 788-871° C. (1450-1600° F.).

16. The process of claim 13, wherein the cooling gas is at a temperature of about 10-260° C. (50-500° F.).

17. The process of claim 13, wherein the cooling gas is at a temperature of about 120-200° C. (250-400° F.).

18. The process of claim 13, wherein the first and second portions of the first radiant flue gas are passed into the first duct from the first plurality of ducts and the second duct from the first plurality of ducts, respectively, in a relatively vertical direction; and, wherein the first and second portions of the second radiant flue gas are passed into the first duct from the second plurality of ducts and the second duct from the second plurality of ducts, respectively, in a relatively vertical direction.

19. The process of claim 18, wherein the first stream of the cooling gas is passed into the at least one opening between the first duct from the first plurality of ducts and the second duct from the first plurality of ducts at a relatively horizontal direction, and wherein the second stream of the cooling gas is passed into the at least one opening between the first duct from the second plurality of ducts and the second duct from the second plurality of ducts at a relatively horizontal direction.

* * * * *